US007378214B2

(12) United States Patent
Lee et al.

(10) Patent No.: US 7,378,214 B2
(45) Date of Patent: May 27, 2008

(54) PREPARATION METHOD OF TONER HAVING MICRO RADIUS

(75) Inventors: Jun-young Lee, Seoul (KR); Sang-woo Kim, Seoul (KR); Kyung-yol Yon, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 415 days.

(21) Appl. No.: 11/139,562

(22) Filed: May 31, 2005

(65) Prior Publication Data

US 2005/0271970 A1 Dec. 8, 2005

(30) Foreign Application Priority Data

Jun. 4, 2004 (KR) ..... 10-2004-0040839

(51) Int. Cl.
*G03G 5/00* (2006.01)

(52) U.S. Cl. ..... 430/137.15

(58) Field of Classification Search ..... 430/137.15
See application file for complete search history.

(56) References Cited

U.S. PATENT DOCUMENTS 4,626,489 A * 12/1986 Hyosu ..... 430/137.15
5,306,593 A * 4/1994 Cunningham et al. . 430/137.15
5,364,728 A * 11/1994 Ohta et al. ..... 430/137.15
6,190,820 B1 2/2001 Patel et al.
6,346,358 B1 2/2002 Cheng
6,455,315 B1 9/2002 Baszczynski et al.
2004/0067429 A1 4/2004 Ueda et al.

FOREIGN PATENT DOCUMENTS

JP 2001-134005 5/2001
JP 2003-167381 6/2003

OTHER PUBLICATIONS

Korean Office Action for corresponding Korean Patent Application No. 10-2004-0040839 dated Feb. 16, 2006.

* cited by examiner

*Primary Examiner*—Mark A Chapman
(74) *Attorney, Agent, or Firm*—Staas & Halsey LLP

(57) ABSTRACT

A preparation method of a toner having a micro diameter includes: blending a monomer and a dispersing agent in distilled water to prepare a monomer dispersion; polymerizing the monomer dispersion by adding a first polymerization initiator to about 1% by volume to about 50% by volume of the monomer, to cause a first polymerization; mixing the remaining monomer dispersion with the polymerized solution; and polymerizing the mixed solution by adding a wax emulsion and a second polymerization initiator, to cause a second polymerization. The present invention may be advantageously used for obtaining spherical, uniformly micro sized toner particles through the emulsion polymerization only, without performing the aggregation or melting process.

26 Claims, No Drawings

PREPARATION METHOD OF TONER HAVING MICRO RADIUS

CROSS-REFERENCE TO RELATED APPLICATIONS

This application claims benefit under 35 U.S.C. § 119 from Korean Patent Application No. 2004-40839, filed on Jun. 4, 2004, the disclosure of which is incorporated herein by reference.

BACKGROUND OF THE INVENTION

1. Field of the Invention

The present invention relates to a preparation method of a toner having a micro radius, and more particularly, to a preparation method of a toner based on a process including an emulsion polymerization, to prepare a toner having a micro radius, so that an effective resolution image may be achieved by an electrophotographic image forming apparatus.

2. Description of the Related Art

Electrophotographic image forming apparatuses include fax machines, LED or LCS printers, digital printers, laser printers, or laser copiers. These apparatuses use toner compositions containing a colorant, a binder resin, a charge control agent, and other functional additives.

Colorants are largely divided into dye colorants and pigment colorants. The pigment colorants, compared to the dye colorants, have an excellent thermal stability and light fastness and thus, are used more often as toner colorants.

The binder resin corresponds to about 90% of the entire toner composition, and its main function is to bind toner particles onto a recording medium. There are many types of polymers that are eligible for use as the binder resin, but a colloid gel type latex with its two components being dispersed to particles is usually used as the binder resin.

The charge controller agent is employed to control the quantity of electric charge on toner particles. Examples of the charge controller agent include metal azo compounds, salicylic acid metal complexes, nigrosine, and quaternary ammonium salts.

Among the functional additives contained in the toner is a releasing agent which gives a neat and quick release. Particularly, the releasing agent is used to more easily release a roller from a toner when a toner image is transferred onto a recording medium, and thus, to prevent a toner offset. Many times, the recording medium adheres to the roller due to the toner, causing the recording medium to be caught in the middle. Hence, the releasing agent is added to the toner composition.

Typically used releasing agents are a polyolefin group having low molecular weight, a silicon group having a softening point by the application of heat, a fatty acid amid group, and wax.

In an electrophotographic image forming apparatus, a toner particle size is a key factor that determines the resolution of a final print image. The more uniform and spherical the toner particles are, and if the toner particles have a micro size, the higher the resolution of a final print image can be.

The preparation methods of a dry toner for use in the electrophotographic image forming apparatus are largely divided into two types: milling and polymerization. The polymerization is further divided into a suspension polymerization and an emulsion polymerization. The milling process, by its nature, is not suitable for making the toner particles spherical in a uniform size. The suspension polymerization has also its limits with respect to obtaining micro size toner particles.

According to the toner preparation method based on a general emulsion polymerization, an emulsion is first prepared with a binder resin, a colorant, and a releasing agent, each component having less than a 1 μm particle size, and later a coagulant is added to the emulsion for aggregation. In this manner, the emulsion is primarily aggregated in a size of 1-3 μm. Next, the emulsion is secondarily aggregated with a latex having a different molecular weight to prepare toner particles in a size between 5 μm and 15 μm.

The emulsion polymerization is well disclosed in U.S. Pat. Nos. 6,120,967, and 5,863,696. In the disclosures, a coagulant is used to aggregate a resin latex, a pigment, and a wax emulsion particle. At first, a latex having a size of 100 nm to 200 nm was aggregated until its size ranged between 1 μm and 3 μm. Then, the latex was subjected to a secondary aggregation process or a melting process. However, this method was not adequate to obtain spherical particles. Moreover, the aggregation and melting processes are very complicated, and have several technical difficulties in adjusting particle size and obtaining spherical particles. Especially, the melting process requires a 2 to 4 hour-heating period. As a result, the entire process becomes very lengthy and complicated.

Therefore, there is a need to develop a new, simple preparation method of spherical microsize toner particles.

SUMMARY OF THE INVENTION

It is, therefore, an aspect of the present invention to provide a preparation method of a toner having a micro diameter based on an emulsion polymerization to prepare a toner having a micro radius, so that an effective resolution image may be achieved by an electrophotographic image forming apparatus using the toner.

To achieve the above aspects and/or other advantages, a preparation method of a toner having a micro diameter comprises: blending a monomer and a dispersing agent in distilled water to prepare a monomer dispersion; polymerizing the monomer dispersion by adding a first polymerization initiator to 1% by volume to 50% by volume of the monomer, to cause a first polymerization; mixing the remaining monomer dispersion with the polymerized solution; and polymerizing the mixed solution by adding a wax emulsion and a second polymerization initiator, to cause a second polymerization.

Preferably, the first polymerization is accomplished within a temperature range between about 50° C. and about 80° C., and the second polymerization also is accomplished within a temperature range between about 50° C. and about 80° C.

Preferably, the monomer dispersion further comprises a pigment.

Preferably, a pigment dispersion is additionally added to the mixed solution for the reaction, wherein the pigment dispersion is a material in which a pigment and a monomer are dispersed.

Preferably, a crosslinking agent is additionally added to the monomer dispersion that is subjected to the first polymerization.

Preferably, a chain transfer agent is additionally added to the mixed solution for the reaction.

Preferably, the monomer in the monomer dispersion is selected from a group consisting of styrene monomers comprising styrene, methylstyrene, chlorostyrene, dichlorostyrene, p-terr-butylstyrene, p-n-butylstyrene, and p-n-nonylstyrene; (meth)acrylic acid ester monomers comprising acrylate, methyl acrylate, ethyl acrylate, propyl acrylate, isobutyl acrylate, n-butyl acrylate, beta carboxy ethyl acrylate, hydroxyethyl acrylate, ethylhexyl acrylate, methacrylate, methyl methacrylate, ethyl methacrylate, propyl methacrylate, n-butyl methacrylate, isobutyl methacrylate, hydroxyethyl methacrylate, and ethylhexyl methacrylate; carboxyl group-containing monomers comprising acrylic acid, itaconic acid, methacrylic acid, maleic acid, fumaric acid, and cinnamic acid; sulfonic acid containing monomers comprising styrene sulfonate; amino styrene and quaternary ammonium salt thereof; monomers with a nitrogen containing hetero ring, including vinylpyridine, and vinylpyrolidone; acrylonitryl, butadiene, isophrene and divinylbenzene; and mixtures thereof.

Preferably, the wax emulsion is selected from a group consisting of natural waxes comprising waxes from a plant including carnauba wax and bayberry wax, and waxes from an animal including beeswax, shellac wax, and spermaceti wax; mineral waxes comprising montan wax, ozokerite wax, and ceresin wax; petroleum based waxes including paraffin wax and microcrystalline wax; and synthetic waxes comprising FISCHER-TROPSCH wax, polyethylene wax, polypropylene wax, acrylate wax, fatty acid amid wax, silicon wax, and polytetrafluoroethylene wax.

Preferably, the first and second polymerization initiators are respectively selected from a group consisting of potassium persulfate, ammonium persulfate, benzoyl peroxide, lauryl peroxide, sodium persulfate, hydrogen peroxide, t-butyl hydroperoxide, cumene hydroperoxide, para-mentane peroxide, and peroxy carbonate.

Preferably, the dispersing agent is selected from a group consisting of anionic surfactants comprising sodium dodecyl sulfate, sodium dodecylbenzene sulfonate, sodium dodecylnaphthalene sulfate, dialkyl benzenealkyl, sulfate, and sulfonate; cationic surfactants comprising dialkyl benzenealkyl ammonium chloride, alkyl benzyl methyl ammonium chloride, alkyl benzyl dimethyl ammonium bromide, benzalconium chloride, cetyl pyridium bromide, dodecylbenzyl triethyl ammonium chloride, lauryl amine acetate, stearyl amine acetate, and lauryl trimethyl ammonium chloride; anionic/cationic surfactants including lauryl dimethylamineoxide; and non-ionic surfactants comprising polyvinyl alcohol, polyacrylic acid, metalose, methyl cellulose, ethyl cellulose, propyl cellulose, hydroxyethyl cellulose, carboxymethyl cellulose, tristyrylphenol ethoxylate phosphate ester, polyoxyethylenecetyl ether, polyoxyethylene lauryl ether, polyoxyethyleneoctyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol.

Preferably, the amount of the wax is within a range from approximately 1 phr to approximately 50 phr.

Preferably, the amount of the first polymerization initiator is within a range from about 1 phr to about 5 phr, and the amount of the second polymerization initiator is also within a range from about 1 phr to about 5 phr.

Preferably, the particle diameter of the prepared toner is within a range from about 1 μm to about 5 μm.

Additional aspects and/or advantages of the invention will be set forth in part in the description which follows and, in part, will be apparent from the description, or may be learned by practice of the invention.

DETAILED DESCRIPTION OF THE PREFERRED EMBODIMENTS

An exemplary embodiment of the present invention will be described herein below.

A dry toner composition for use in an electrophotographic image forming apparatus consists of toner particles containing a colorant, a charge control agent, a binder resin, and other additives mixed at a predetermined ratio. To achieve an effective-resolution print image, it is very important that printed dots are uniform and have a minimized size. In other words, the toner particles are spherical, and uniformly micro in size.

To prepare a toner having a micro radius, a monomer dispersion needs to be prepared at first, by dispersing a monomer and a dispersing agent in distilled water.

Any radically polymerizable monomers may be used for the monomer dispersion. Examples of radical polymerizable monomer include styrene monomers including styrene, methylstyrene, chlorostyrene, dichlorostyrene, p-terr-butylstyrene, p-n-butylstyrene, and p-n-nonylstyrene; (meth) acrylic acid ester monomers including acrylate, methyl acrylate, ethyl acrylate, propyl acrylate, isobutyl acrylate, n-butyl acrylate, beta carboxy ethyl acrylate, hydroxyethyl acrylate, ethylhexyl acrylate, methacrylate, methyl methacrylate, ethyl methacrylate, propyl methacrylate, n-butyl methacrylate, isobutyl methacrylate, hydroxyethyl methacrylate, and ethylhexyl methacrylate; carboxyl group-containing monomers including acrylic acid, itaconic acid, methacrylic acid, maleic acid, fumaric acid, and cinnamic acid; sulfonic acid containing monomers including styrene sulfonate; amino styrene and quaternary ammonium salt thereof; monomers with a nitrogen containing hetero ring, which include vinylpyridine, and vinylpyrolidone; acrylonitryl, butadiene, isophrene, and divinylbenzene, or mixtures thereof. These examples are for illustrative purposes only.

The above-described monomers are used for first and second polymerizations, which will be described later. In the first polymerization, the monomer functions as a polymerization seed monomer, and in the second polymerization, a polymer that is polymerized with the seed monomer functions as a seed again, to be polymerized with remaining monomers.

Preferably, the first polymerization is accomplished within a temperature range between about 50° C. and about 80° C., and the second polymerization also is accomplished within a temperature range between about 50° C. and about 80° C.

Preferably, the monomer dispersion further comprises a pigment.

Preferably, a pigment dispersion is additionally added to the mixed solution for the reaction, wherein the pigment dispersion is a material in which a pigment and a monomer are dispersed.

Preferably, a crosslinking agent is additionally added to the monomer dispersion that is subjected to the first polymerization.

Preferably, a chain transfer agent is additionally added to the mixed solution for the reaction.

Although one of water-soluble polymers, surfactants, and inorganic compounds may be used as the dispersing agent, surfactants are the most frequently used ones. Examples of the surfactants usable for the dispersing agent of the present invention include anionic surfactants including sodium dodecyl sulfate, sodium dodecylbenzene sulfonate, sodium dodecylnaphthalene sulfate, dialkyl benzenealkyl, sulfate, and sulfonate; cationic surfactants including dialkyl benzenealkyl ammonium chloride, alkyl benzyl methyl ammonium chloride, alkyl benzyl dimethyl ammonium bromide, benzalconium chloride, cetyl pyridium bromide, dodecylbenzyl triethyl ammonium chloride, lauryl amine acetate, stearyl amine acetate, and lauryl trimethyl ammonium chloride; anionic/cationic surfactants including lauryl dimethylamineoxide; and non-ionic surfactants including polyvinyl alcohol, polyacrylic acid, metalose, methyl cellulose, ethyl cellulose, propyl cellulose, hydroxyethyl cellulose, carboxymethyl cellulose, tristyrylphenol ethoxylate phosphate ester, polyoxyethylenecetyl ether, polyoxyethylene lauryl ether, polyoxyethyleneoctyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol; or mixtures thereof. These examples are for illustrative purposes only.

Examples of surfactants that are commercially used now include DOWFAX produced by DOW CHEMICAL COMPANY, TERGITOL, and Triton.

Preferably, deionized water is used for the preparation of the dispersion with the monomer and the surfactant. The deionized water is prepared by bubbling nitrogen gas through deionized water, and deoxidizing the water.

The monomer dispersion may further contain a pigment. The pigment is used as a toner colorant. The pigment may be added once at any suitable time, or added fractionally in consideration of its dispersibility in the dispersion.

Examples of the pigments for use in the present invention include organic pigments including azo pigments, phthalocyanine pigments, basic dyes, quinacridone pigments, dioxazine pigments, and diazo pigment; carbon black; inorganic pigments including chromate, ferrocyanices, oxide, selenium sulfide, sulfate, silicate, carbonate, phosphate, and metal powder; or mixtures thereof. The examples here are for illustrative purposes only. If the environment factor is taken into consideration, it is preferable to use organic pigments, and carbon black as a black pigment.

Examples of organic pigments for use in the present invention are as follows:

Blue and/or green pigments: copper phthalocyanine, C.I.P.B. (C.I. PIGMENT BLUE) 15, 15:1, 15:2, 15:3, 15:4, 15:6, 16 (metal-free phthalocyanine) or aluminum phthalocyanine, nickel phthalocyanine, vanadium phthalocyanine, and bridged phthalocyanine dimer/oligomer (e.g., Si-bridged phthalocyanine); orange pigments: P.O.5, 13, 34, 36, 43, 62, 71, and 72; yellow pigments: P.Y.12, 17, 74, 83, 93, 122, 146, 155, 180, 174, and 185; red pigments: P.R.48, 57, 122, 146, 147, 176, 184, 186, 202, 207, 238, 254, 255, 269, 270, and 272; violet pigments: P.V.1, 19, and 23; and pigment mixture: P.V.19/P.R.122 or P.R.146/147.

The above-described monomer, the dispersing agent, and the pigment (optional) are blended in deionized water, and the resulting mixture is poured into a reaction vessel to be homogenized with the aid of a homogenizer. As for the homogenizer, a homomixer, a pressure kneader/cotter, an extruder and media distributor, a ball mill having media, a sand mill, or a dino mill may be utilized. The homogenization process was carried out at 1000 rpm to 10000 rpm for about 1 min-60 min.

Then, 1% by volume to 50% by volume of the monomer dispersion was reacted with a first polymerization initiator. The monomer in the monomer dispersion functions as a seed in the first polymerization. The polymerization was carried out at a temperature range from 50° C. to 80° C. for about 1 to 4 hours.

The polymerization initiators are largely divided into water soluble initiators and oil soluble initiators. Even though it is not an absolute requirement for the present invention, water soluble initiators are more preferably used. Examples of the water-soluble polymerization initiator include potassium persulfate, ammonium persulfate, benzoyl peroxide, lauryl peroxide, sodium persulfate, hydrogen peroxide, t-butyl hydroperoxide, cumene hydroperoxide, para-mentane peroxide, peroxy carbonate, or mixtures thereof. These examples are for illustrative purposes only.

The amount of the polymerization initiator is preferably in a range of about 1 phr to about 5 phr, which is determined according to the amounts of other additives participating in the polymerization reaction. Here, the term 'phr' is an abbreviation for 'part per hundreds of resin', and refers to a mass unit of an object additive per hundred parts of resin.

The monomer dispersion subjected to the first polymerization may further contain a crosslinking agent. When a crosslinking agent is used, the polymerization may be done more effectively. Although the amount of the crosslinking agent is determined in dependence of the amount of the monomer participating in the polymerization, an extremely small quantity of the crosslinking agent is usually added. Generally, an extremely small quantity, such as less than 2 mg is usually added. The crosslinking agent for use in the present invention is a radical polymerization crosslinking agent having two or more unsaturated bonds. Examples of the radical polymerization crosslinking agent include divinylbenzene, divinyl naphthalene, divinyl ether, diethyleneglycol methacrylate, ethyleneglycol dimethacrylate, polyethyleneglycol dimethacrylate, diallyl phthalate, or common crosslinking agents used in the related art.

The remaining monomer dispersion, except for the polymerization seed, is mixed with the solution wherein the first polymerization took place. Then, a second polymerization initiator is added to this mixed solution. A polymer generated from the first polymerization functions as a polymerization seed again, and polymerizes with a monomer in the remaining monomer dispersion. Throughout the polymerization, a wax particle in the wax emulsion is encapsulated in a latex resin and thus, forms a toner particle.

Any commercially available wax emulsions may be used for an emulsion polymerization of the invention, or commercially available waxes may be used to prepare an emulsion.

Examples of the wax emulsion for use in the present invention include natural waxes, including waxes from a plant, e.g., carnauba wax and bayberry wax, and waxes from an animal, e.g., beeswax, shellac wax, and spermaceti wax; mineral waxes including montan wax, ozokerite wax, and ceresin wax; petroleum based waxes including paraffin wax and microcrystalline wax; and synthetic waxes including FISCHER-TROPSCH wax, polyethylene wax, polypropylene wax, acrylate wax, fatty acid amide wax, silicon wax, and polytetrafluoroethylene wax, or mixtures thereof. These examples are for illustrative purposes only.

Preferably, the addition amount of the wax to the wax emulsion is within a range from about 1 phr to about 50 phr. If the amount of the wax is less than about 1 phr, it cannot fully function as a releasing agent. On the other hand, if the amount of the wax is greater than about 50 phr, the amount of the other additives, including the colorant, becomes relatively low, so the toner's own physical properties are not fully exhibited.

Although optional, it is more preferable to add a pigment dispersion to the above-described mixed solution. A pigment dispersion is prepared by blending and dispersing a pigment and a monomer. Examples of the pigment and the monomer for use in the preparation of the pigment dispersion are the same as the ones already described before, so they will not be discussed here again. To prepare the pigment dispersion, a pigment and a monomer are dispersed in an ultrasonic homogenizer or an ultrasonic water bath, and the mass ratio of the pigment to the monomer is within a range between about 1:20 and about 1:5.

Optionally, a chain transfer agent may be further added to the above described mixed solution. Particularly, the chain transfer agent serves to adjust an object molecular weight of a final polymer.

Examples of the chain transfer agent include octyl mercaptan, and dodecyl mercaptan, but again, these examples are for illustrative purposes only.

The first polymerization initiator may also be used as the second polymerization initiator for the second polymerization. The amount of the first and the second polymerization initiator is within a range from about 1 phr to about 5 phr, respectively, and is usually determined according to the amounts of the monomer and other additives participating in the polymerization.

As described above, a toner particle is prepared by adding a charge control agent and other required additives to the latex resin containing the wax, and/or the latex resin containing the wax and the pigment.

In short, the emulsion polymerization is the only process involved in the preparation of the toner particle, and the aggregation or melting process is no longer needed. Thus, it becomes possible to adjust the particle size and to obtain spherical uniform toner particles. The diameter of a finally produced toner particle is preferably within a range from about 1 μm to about 5 μm. Therefore, the amounts of the elements participating in the polymerization are adjusted to prepare the toner particles to have the above micro diameter.

The present invention will now be explained in more detail with reference to the following examples.

EXAMPLES

Example 1

Styrene, butyl acrylate, and acrylic acid were mixed together at a ratio of 7:2:1 to prepare 100 g of a monomer mixture. 3 g of DOWFAX and 3 g of TRITON X-100 were dissolved in 200 g of deionized water. The resulting solution and the monomer mixture were blended in a 1 L reaction vessel, and were stirred to be homogenized at about 7000 rpm for three minutes with the aid of the IKA ULTRA TURREX, to prepare a monomer dispersion.

10% by volume of the monomer dispersion was put into a reaction tank, and heated to 75° C. while being stirred at about 100 rpm. Then, 2 g of ammonium persulfate was added to the reaction tank, and the reaction vessel atmosphere was purged with nitrogen gas. Polymerization continued for 2 hours to prepare a polymerized polymer.

The polymerized polymer was mixed with the remaining 90% by volume of the monomer dispersion, and was homogenized with the aid of a homogenizer. The homogenized solution was heated to about 75° C. for about 30 minutes. Then, 2 g of potassium persulfate and 25 g of a carnauba wax emulsion were added to the solution, and were stirred at 200 rpm for about 30 minutes.

5 g of P.B.15:3 and 50 g of styrene were blended in a 100 mL beaker, and the beaker was put in an ultrasonic tank for about 30 minutes to obtain a pigment dispersion.

The stirred solution, the pigment dispersion, and a charge control agent were mixed, and the resulting mixture was subjected to the polymerization for about 6 hours and was cooled to room temperature.

The volume average particle size of a final toner particle was approximately 3 μm.

Example 2

Toner particles were obtained in the same manner as in Example 1, except that 5 g of P.B.15:3 was additionally added.

The volume average particle size of a final toner particle was approximately 3 μm.

Example 3

Toner particles were obtained in the same manner as in Example 1, except that behenyl acrylate (BHA) was used instead of the carnauba wax emulsion to prepare the wax emulsion.

The volume average particle size of a final toner particle was approximately 2 μm.

Example 4

Toner particles were obtained in the same manner as in Example 1, except that the pigment dispersion was not added to the polymerized polymer solution.

The volume average particle size of a final toner particle was approximately 3 μm.

Example 5

Toner particles were obtained in the same manner as in Example 1, except that P.Y.180 was used instead of P.B.15:3.

The volume average particle size of a final toner particle was approximately 3 μm.

Example 6

Toner particles were obtained in the same manner as in Example 1, except that P.R.122 was used instead of P.B.15:3.

The volume average particle size of a final toner particle was approximately 3 μm.

Example 7

Toner particles were obtained in the same manner as in Example 1, except that NIPEX 70 (carbon black) was used instead of P.B.15:3.

The volume average particle size of a final toner particle was approximately 3 μm.

In conclusion, toner particles may be obtained through a simple preparation process, such as the emulsion polymerization, without the aggregation or melting process. Thusly obtained toner particles are spherical and uniformly micro in size. Therefore, when these toner particles are used in the electrophotographic image forming apparatus, an effective resolution image may be obtained.

The foregoing embodiment and advantages are merely exemplary and are not to be construed as limiting the present invention. The present teaching may be readily applied to other types of apparatuses. Also, the description of the embodiments of the present invention is intended to be illustrative, and not to limit the scope of the claims, and many alternatives, modifications, and variations will be apparent to those skilled in the art. Hence, changes may be made in these embodiments without departing from the principles and spirit of the invention, the scope of which is defined in the claims and their equivalents.

What is claimed is:

1. A preparation method of a toner having a micro diameter, the method comprising:

blending a monomer and a dispersing agent in distilled water to prepare a monomer dispersion;

polymerizing the monomer dispersion by adding a first polymerization initiator to about 1% by volume to about 50% by volume of the monomer, to cause a first polymerization;

mixing a remaining monomer dispersion with the polymerized solution; and polymerizing the mixed solution by adding a wax emulsion and a second polymerization initiator, to cause a second polymerization.

2. The method according to claim 1, wherein the first polymerization is accomplished within a temperature range between about 50° C. and about 80° C.

3. The method according to claim 1, wherein the second polymerization is accomplished within a temperature range between about 50° C. and about 80° C.

4. The method according to claim 1, wherein the monomer dispersion containing the monomer further comprises a pigment.

5. The method according to claim 4, wherein the pigment is selected from the group consisting of organic pigments including azo pigments, phthalocyanine pigments, basic dyes, quinacridone pigments, dioxazine pigments, diazo pigment; carbon black; inorganic pigments including chromate, ferrocyanices, oxide, selenium sulfide, sulfate, silicate, carbonate phosphate, and metal powder; and mixtures thereof.

6. The method according to claim 4, wherein the pigment is selected from the group of blue and/or green pigments: copper phthalocyanine, C.I. PIGMENT BLUE 15, 15:1, 15:2, 15:3, 15:4, 15:6, 16 (metal-free phthalocyanine) or aluminum phthalocyanine, nickel phthalocyanine, vanadium phthalocyanine, and bridged phthalocyanine dimer/oligomer; orange pigments: P.O.5, 13, 34, 36, 43, 62, 71, and 72; yellow pigments: P.Y.12, 17, 74, 83, 93, 122, 146, 155, 180, 174, and 185; red pigments: P.R.48, 57, 122, 146, 147, 176, 184, 186, 202, 207, 238, 254, 255, 269, 270, and 272; violet pigments: P.V.1, 19, and 23; and pigment mixture: P.V.19/P.R.122 and P.R.146/147.

7. The method according to claim 1, wherein a pigment dispersion is additionally added to the mixed solution for the reaction.

8. The method according to claim 7, wherein the pigment dispersion is a material in which a pigment and a monomer are dispersed.

9. The method according to claim 1, wherein a crosslinking agent is additionally added to the monomer dispersion subjected to the first polymerization.

10. The method according to claim 9, wherein the crosslinking agent is a radical polymerization crosslinking agent having at least two unsaturated bonds.

11. The method according to claim 10, wherein the radical polymerization crosslinking agent is selected from the group consisting of divinylbenzene, divinyl naphthalene, divinyl ether, diethyleneglycol methacrylate, ethyleneglycol dimethacrylate, polyethyleneglycol dimethacrylate, and diallyl phthalate.

12. The method according to claim 1, wherein a chain transfer agent is additionally added to the mixed solution for the reaction.

13. The method according to claim 12, wherein the chain transfer agent is selected from the group consisting of octyl mercaptan and dodecyl mercaptan.

14. The method according to claim 1, wherein the monomer is selected from a group consisting of styrene monomers comprising styrene, methylstyrene, chlorostyrene, dichlorostyrene, p-terr-butylstyrene, p-n-butylstyrene, and p-n-nonylstyrene; (meth)acrylic acid ester monomers comprising acrylate, methyl acrylate, ethyl acrylate, propyl acrylate, isobutyl acrylate, n-butyl acrylate, beta carboxy ethyl acrylate, hydroxyethyl acrylate, ethylhexyl acrylate, methacrylate, methyl methacrylate, ethyl methacrylate, propyl methacrylate, n-butyl methacrylate, isobutyl methacrylate, hydroxyethyl methacrylate, and ethylhexyl methacrylate; carboxyl group-containing monomers comprising acrylic acid, itaconic acid, methacrylic acid, maleic acid, fumaric acid, and cinnamic acid; sulfonic acid containing monomers comprising styrene sulfonate; amino styrene and quaternary ammonium salt thereof; monomers with a nitrogen containing hetero ring, including vinylpyridine, and vinylpyrolidone; acrylonitryl, butadiene, isophrene and divinylbenzene; and mixtures thereof.

15. The method according to claim 1, wherein the wax emulsion is selected from a group consisting of natural waxes comprising waxes from a plant including carnauba wax and bayberry wax, and waxes from an animal including beeswax, shellac wax, and spermaceti wax; mineral waxes comprising montan wax, ozokerite wax, and ceresin wax; petroleum based waxes including paraffin wax and microcrystalline wax; and synthetic waxes comprising FISCHER-TROPSCH wax, polyethylene wax, polypropylene wax, acrylate wax, fatty acid amide wax, silicon wax, and polytetrafluoroethylene wax.

16. The method according to claim 1, wherein the first and second polymerization initiators are respectively selected from a group consisting of potassium persulfate, ammonium persulfate, benzoyl peroxide, lauryl peroxide, sodium persulfate, hydrogen peroxide, t-butyl hydroperoxide, cumene hydroperoxide, para-mentane peroxide, and peroxy carbonate.

17. The method according to claim 1, wherein the dispersing agent is selected from a group consisting of anionic surfactants comprising sodium dodecyl sulfate, sodium dodecylbenzene sulfonate, sodium dodecylnaphthalene sulfate, dialkyl benzenealkyl, sulfate, and sulfonate; cationic surfactants comprising dialkyl benzenealkyl ammonium chloride, alkyl benzyl methyl ammonium chloride, alkyl benzyl dimethyl ammonium bromide, benzalconium chloride, cetyl pyridium bromide, dodecylbenzyl triethyl ammonium chloride, lauryl amine acetate, stearyl amine acetate, and lauryl trimethyl ammonium chloride; anionic/cationic surfactants including lauryl dimethylamineoxide; and nonionic surfactants comprising polyvinyl alcohol, polyacrylic acid, metalose, methyl cellulose, ethyl cellulose, propyl cellulose, hydroxyethyl cellulose, carboxymethyl cellulose, tristyrylphenol ethoxylate phosphate ester, polyoxyethyleneceteyl ether, polyoxyethylene lauryl ether, polyoxyethyleneoctyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol.

18. The method according to claim 1, wherein the amount of the wax is within a range from about 1 phr to about 50 phr.

19. The method according to claim 1, wherein the amount of the first polymerization initiator is within a range from about 1 phr to about 5 phr.

20. The method according to claim 1, wherein the amount of the second polymerization initiator is within a range from about 1 phr to about 5 phr.

21. The method according to claim 1, wherein the particle diameter of the prepared toner is within a range from about 1 μm to about 5 μm.

22. The method according to claim 1, wherein, in the first polymerization, the monomer functions as a polymerization seed monomer, and in the second polymerization, a polymer that is polymerized with the polymerization seed monomer functions as a seed again, and is polymerized with remaining monomers.

23. The method according to claim 1, wherein the monomer and the dispersing agent are blended in deionized water, and a resulting mixture is poured into a reaction vessel to be homogenized with the aid of a homogenizer.

24. The method according to claim 23, wherein the homogenizer is selected from the group consisting of a homomixer, a pressure kneader/cotter, an extruder and media distributor, a ball mill having media, a sand mill, and a dino mill.

25. The method according to claim 24, wherein a homogenization process is carried out at 1000 rpm to 10000 rpm for about 1 mm 60 mm.

26. The method according to claim 1, wherein a charge control agent is additionally added to the wax emulsion.

* * * * *

UNITED STATES PATENT AND TRADEMARK OFFICE

CERTIFICATE OF CORRECTION

PATENT NO. : 7,378,214 B2
APPLICATION NO. : 11/139562
DATED : May 27, 2008
INVENTOR(S) : Jun-young Lee et al.

It is certified that error appears in the above-identified patent and that said Letters Patent is hereby corrected as shown below:

Column 9, Line 35, change “ferrocyanices” to --ferrocyanides--.

Column 9, Line 36, after “carbonate” insert --,--.

Column 10, Line 10, change “p-terr” to --p-tert--.

Column 10, Line 23-24, change “vinylpyrolidone” to --vinylpyrrolidone--.

Column 10, Line 24, change “isophrene” to --isoprene--.

Column 10, Line 43, change “mentane” to --menthane--.

Column 10, Line 52, change “benzalconium” to --benzalkonium--.

Column 12, Line 12, change “1 mm 60 mm” to --1 min-60 min--.

Signed and Sealed this

Seventh Day of October, 2008

JON W. DUDAS
*Director of the United States Patent and Trademark Office*